US007677168B1

(12) United States Patent
Liu et al.

(10) Patent No.: US 7,677,168 B1
(45) Date of Patent: Mar. 16, 2010

(54) EASY-MAINTENANCE STRAP GUIDE SYSTEM OF A STRAPPING MACHINE

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 0 days.

(21) Appl. No.: 12/413,640

(22) Filed: Mar. 30, 2009

(51) Int. Cl.
*B65B 13/04* (2006.01)

(52) U.S. Cl. ..... 100/26; 100/32; 53/589

(58) Field of Classification Search ..... 100/25, 100/26, 29, 32, 33 PB; 53/589
See application file for complete search history.

(56) References Cited

U.S. PATENT DOCUMENTS 4,516,488 A * 5/1985 Bartzick et al. ..... 100/4
4,817,519 A * 4/1989 Brouse et al. ..... 100/32
6,041,698 A * 3/2000 Chin-Chang et al. ..... 100/26
6,857,252 B2 * 2/2005 Haberstroh et al. ..... 53/589
7,287,464 B1 * 10/2007 Kirar et al. ..... 100/26
7,377,212 B1 * 5/2008 Wang ..... 100/26
7,395,754 B1 * 7/2008 Bobren et al. ..... 100/26

* cited by examiner

*Primary Examiner*—Jimmy T Nguyen
(74) *Attorney, Agent, or Firm*—Ming Chow; Sinorica, LLC

(57) ABSTRACT

An easy-maintenance strap guide system of a strapping machine includes a board, a driving set, a first rod, a second rod, a first matching portion, a second matching portion, and an engaging element. The driving set includes an advance roller portion and a retreat roller portion for conveying a strap. When the engaging element disengages with the first rod, the first rod rotates and makes the second rod, the first matching and the second matching portion moving. Hence, a maintenance space is formed. Thus, the maintenance work can be done quickly without the use of tools. It saves the detaching and assembling time. Plus, it can release automatically due to the gravity.

3 Claims, 6 Drawing Sheets

EASY-MAINTENANCE STRAP GUIDE SYSTEM OF A STRAPPING MACHINE

BACKGROUND OF THE INVENTION

1. Field of the Invention

The present invention relates to an easy-maintenance strap guide system of a strapping machine, and particularly to an easy-maintenance strap guide system of a strapping machine without the use of tools by utilizing a unique linking mechanism. About this invention, the maintenance work can be done quickly without the use of tools. It saves the detaching and assembling time. Plus, it can release automatically due to the gravity.

2. Description of the Prior Art

Most malfunctions of a strapping machine are caused by a jammed or stuck strap in the strap guide slot of the strapping machine. Consequently, the strap advance or retreat process will be influenced. In order to overcome these malfunctions, the user usually needs to detach four to six fixing elements (such as bolts, screws, etc.) and then to disassemble the attached parts covering the strap guide slot. After which, the user can inspect or repair the jammed or stuck strap. Once the malfunction is overcome, the user can install the related parts back. However, it is very time-consuming and inconvenient.

As shown in FIG. 1, when the user wants to repair the conventional strapping machine 90, four fixing elements 911 on the covering part 91 must be removed first. Then, it is possible to inspect or repair the breakdown. After which, the user has to install the detached ones back again. It is very inconvenient and time-consuming.

SUMMARY OF THE INVENTION

The objects of this invention are to provide an easy-maintenance strap guide system of a strapping machine that has the following advantages and functions. The maintenance work can be done quickly without the use of tools. It saves the detaching and assembling time. Plus, it can release automatically due to the gravity. So, the conventional problems can be solved accordingly.

In order to achieve the above objects, this invention is provided. An easy-maintenance strap guide system of a strapping machine comprising:

a board having a first surface, a second surface, a first guiding hole, a second guiding hole and an opening, the first guiding hole, the second guiding hole and the opening penetrating from the first surface to the second surface;

a driving set disposed on the first surface of the board, the driving set including an advance roller portion and a retreat roller portion, the advance roller portion having a first guide slot, the retreat roller portion having a second guide slot; the advance roller portion and the retreat roller portion being driven by a first driving device and a second driving device respectively; the first guide slot and the second guide slot being provided for allowing a strap conveying therein;

a first rod disposed on the first surface, the first rod having a fixing portion, a first pivoting portion and a first rotating portion; the first rotating portion being disposed on the first surface so as to allow the first rod rotating within a predetermined range;

a second rod disposed on the second surface, the second rod having a first sliding portion, a second sliding portion, a linking arm and a second rotating portion; the first sliding portion and the second sliding portion being able to move inside the first guide slot and the second guide slot respectively; the second rotating portion being disposed on the second surface so as to allow the second rod rotating within another predetermined range;

a first matching portion disposed on the first surface, the first matching portion having a second pivoting portion and a third portion; the first sliding portion and the second sliding portion being through the first guide slot and the second sliding slot respectively as well as being pivoted with the second pivoting portion and the third pivoting portion respectively;

a second matching portion disposed on the first surface, the second matching portion having a fourth pivoting portion, the fourth pivoting portion being through the opening, the fourth pivoting portion having two ends, one end of the fourth pivoting portion being pivoted with the first pivoting portion of the first pivoting portion, the other end of the fourth pivoting portion being pivoted with the linking arm of the second rod; and an engaging element having a locking portion so as to engage or disengage with the first rod;

wherein when the locking porting engages with the fixing portion of the first rod, both the first matching portion and the second matching portion contact with the first and second guide slots so as to limit the strap that is movable in the first and second guide slots and to cause the second matching portion presses on the first matching portion; when the locking portion disengages with the fixing portion of the first rod, the first rod rotates and makes the second rod, the first matching and the second matching portion moving so that the second matching portion separates from the first matching portion and the second guide slot, and the first matching portion separates from the first guide slot.

DETAILED DESCRIPTION OF THE PREFERRED EMBODIMENT

Figure 1:
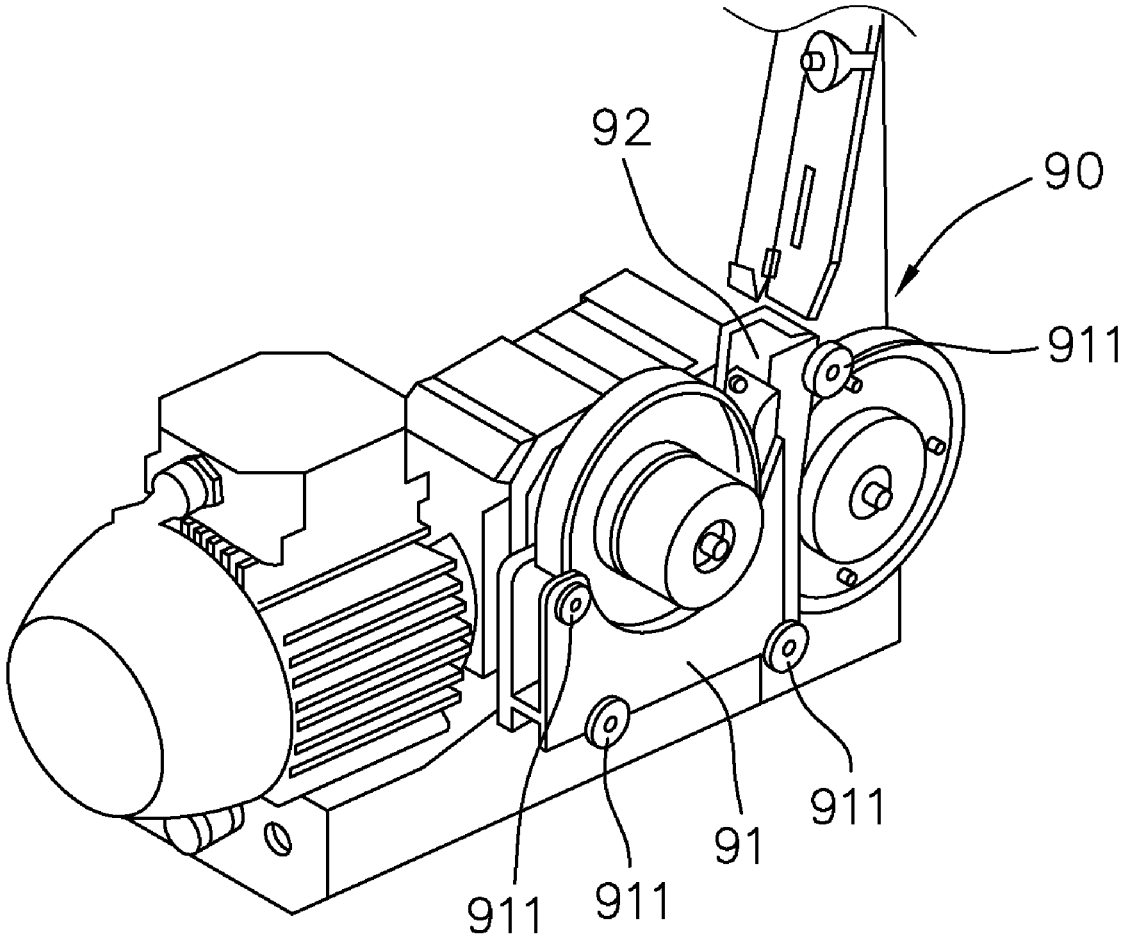
FIG.1 (PRIOR ART)
FIG. 1 is a perspective view of a selected portion of a conventional strapping machine.
Figure 2:
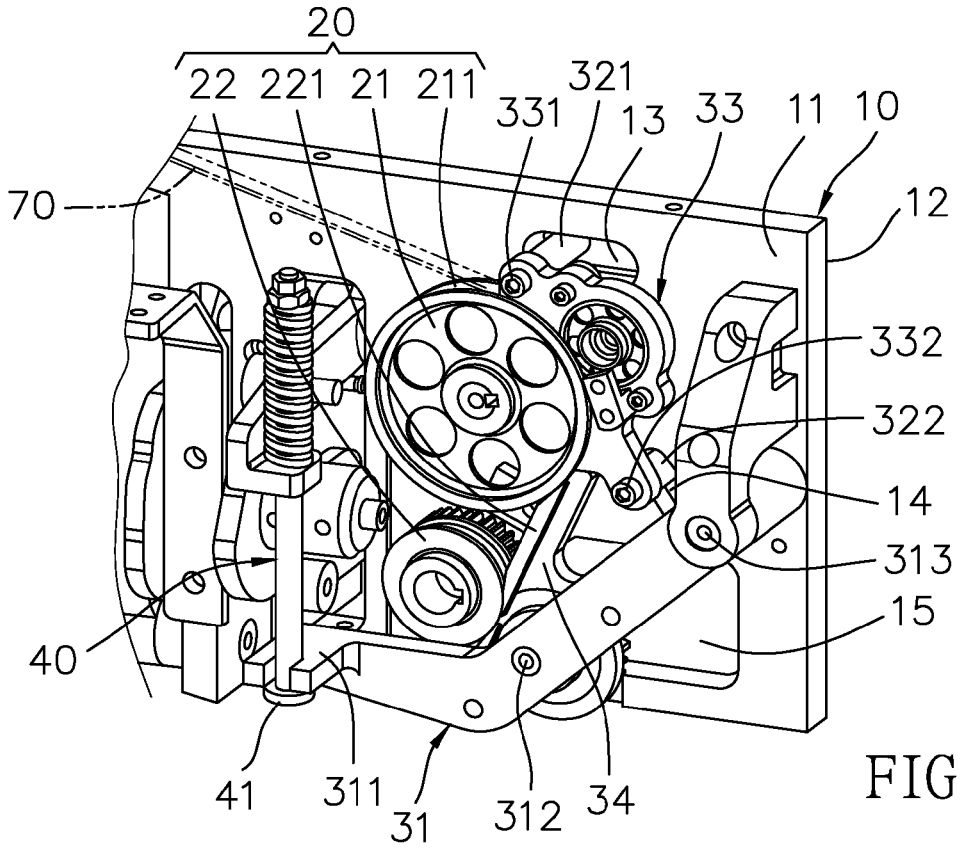
FIG. 2 is a perspective view showing the first surface of this invention when the first rod is engaged.
Figure 3:
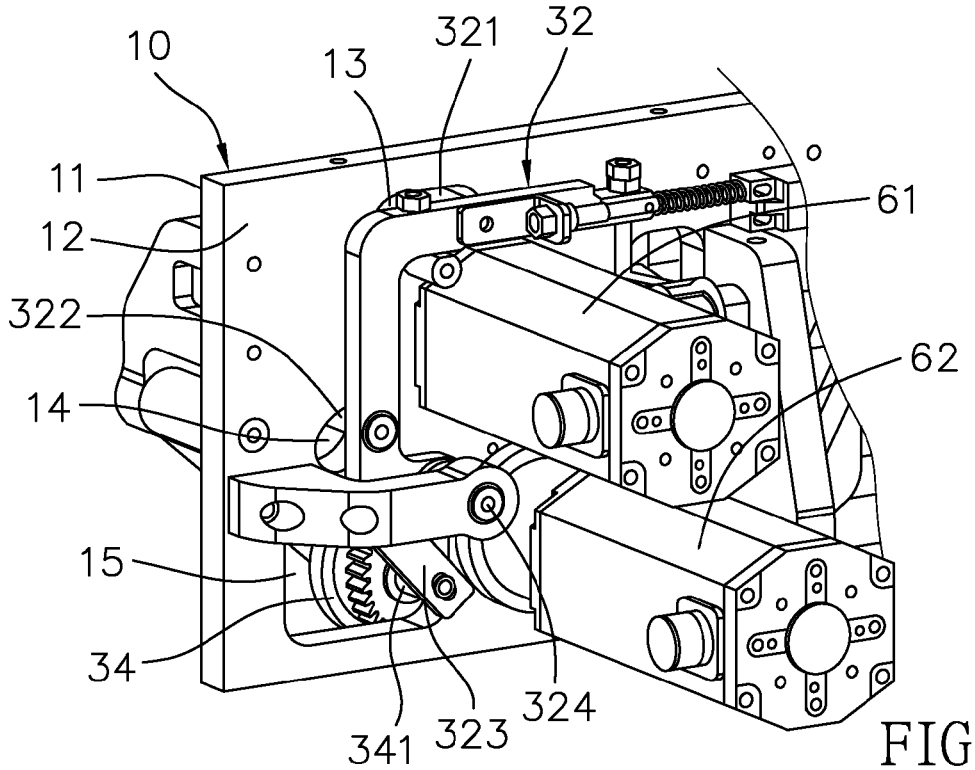
FIG. 3 is a perspective view showing the second surface of this invention when the first rod is engaged.
Figure 4:
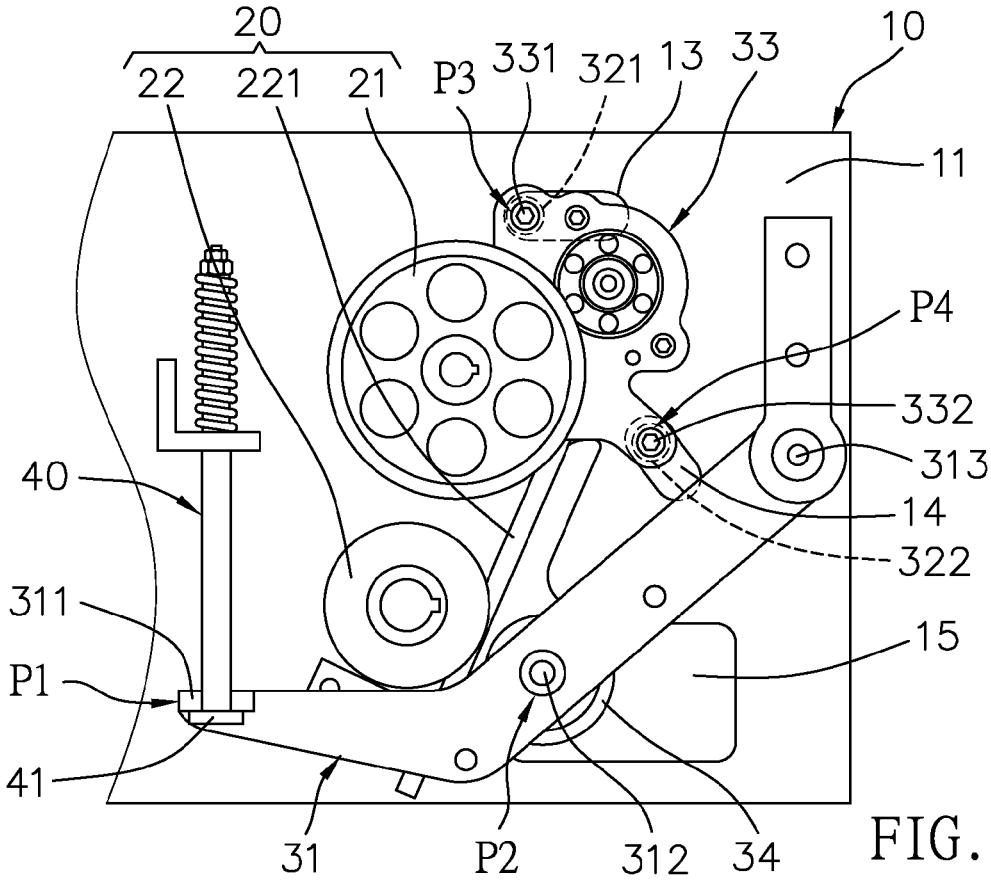
FIG. 4 is a view illustrating the first surface of this invention when the first rod is engaged.
Figure 5:
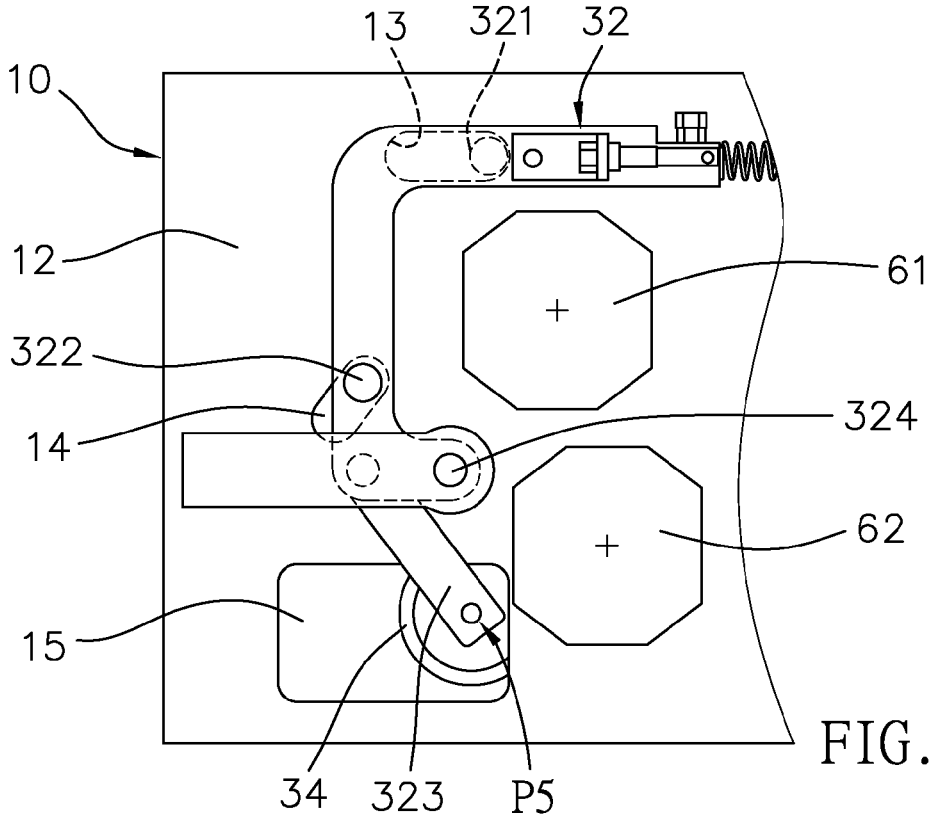
FIG. 5 is a view illustrating the second surface of this invention when the first rod is engaged.

Referring to FIGS. 2 and 3, the present invention is an easy-maintenance strap guide system of a strapping machine. It mainly includes a board 10, a driving set 20, a first rod 31, a second rod 32, a first matching portion 33, a second matching portion 34, and an engaging element 40.

About this board 10, it has a first surface 11, a second surface 12, a first guiding hole 13, a second guiding hole 14 and an opening 15. The first guiding hole 13, the second guiding hole 14 and the opening 15 penetrates from the first surface 11 to the second surface 12.

With regard to this driving set 20, it is disposed on the first surface 11 of the board 10. The driving set 20 includes an advance roller portion 21 and a retreat roller portion 22. The advance roller portion 21 has a first guide slot 211. The retreat roller portion 22 has a second guide slot 221. Further, the advance roller portion 21 and the retreat roller portion 22 are driven by a first driving device 61 and a second driving device 62 respectively. The first guide slot 211 and the second guide slot 221 are provided for allowing a strap 70 conveying therein.

The first rod 31 is disposed on the first surface 11. The first rod 31 has a fixing portion 311, a first pivoting portion 312 and a first rotating portion 313. The first rotating portion 313 is disposed on the first surface 11 so as to allow the first rod 31 rotating within a predetermined range.

Concerning the second rod 32, it is disposed on the second surface 12. The second rod 32 has a first sliding portion 321, a second sliding portion 322, a linking arm 323 and a second rotating portion 324. Moreover, the first sliding portion 321 and the second sliding portion 322 are able to move inside the first guide slot 13 and the second guide slot 14 respectively. The second rotating portion 324 is disposed on the second surface 12 so as to allow the second rod 32 rotating within another predetermined range.

About this first matching portion 33, it is disposed on the first surface 11. The first matching portion 33 has a second pivoting portion 331 and a third portion 332. The first sliding portion 321 and the second sliding portion 322 are through the first guide slot 13 and the second sliding slot 14 respectively as well as are pivoted with the second pivoting portion 331 and the third pivoting portion 332 respectively.

The second matching portion 34 is disposed on the first surface 11. The second matching portion 34 has a fourth pivoting portion 341. The fourth pivoting portion 341 is through the opening 15. Plus, said fourth pivoting portion 341 has two ends. One end of the fourth pivoting portion 341 is pivoted with the first pivoting portion 312 of the first pivoting portion 31. The other end of the fourth pivoting portion 312 is pivoted with the linking arm 323 of the second rod 32.

The engaging element 40 has a locking portion 41 so as to engage or disengage with the first rod 31.

Therefore, when the locking portion 41 engages with the fixing portion 311 of the first rod 31, both the first matching portion 33 and the second matching portion 34 contact with the first and second guide slots 211, 221 so as to limit the strap 70 that is movable in the first and second guide slots 211, 221 and to cause the second matching portion 34 pressing on the first matching portion 33. When the locking portion 41 disengages with the fixing portion 311 of the first rod 31, the first rod 31 rotates and makes the second rod 32, the first matching 33 and the second matching portion 34 moving so that the second matching portion 34 separates from the first matching portion 33 and the second guide slot 221. Also, the first matching portion 33 separates from the first guide slot 211.

As shown in FIGS. 2, 3, 4 and 5, when the locking portion 41 engages with the fixing portion 311 of the first rod 31, the fixing portion 311 is positioned at a first position P1. The first pivoting portion 312 is positioned at a second position P2. The second pivoting portion 331 and the third pivoting portion 332 are positioned at a third position P3 and a fourth position P4 respectively. The linking arm 323 of the second rod 32 is positioned at a fifth position P5.

Figure 6A:
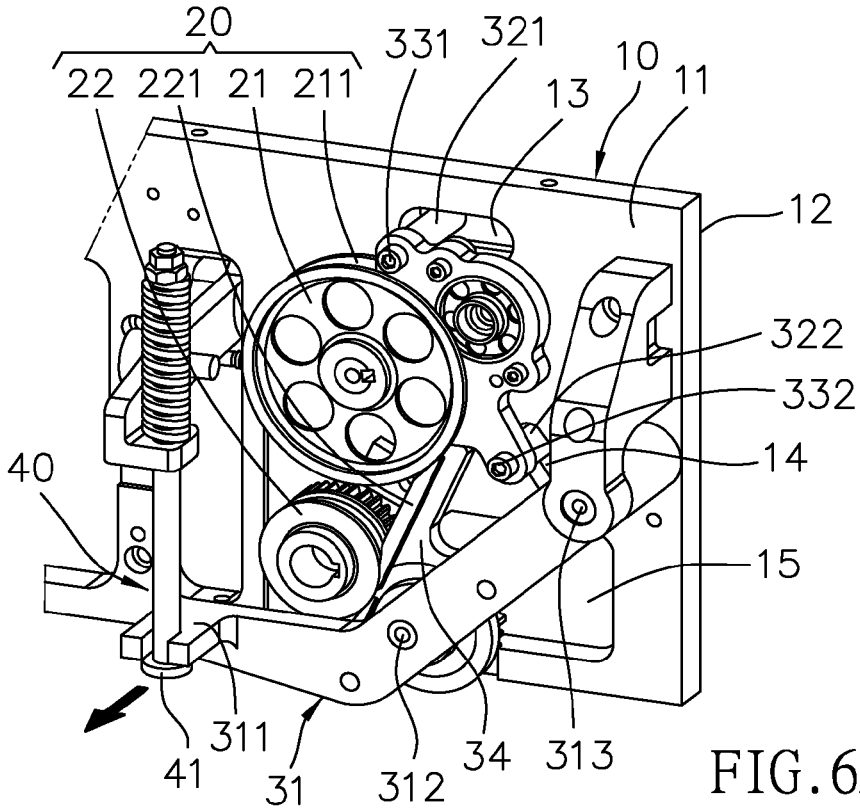
FIG. 6A is a perspective view showing one operating condition.
Figure 6B:
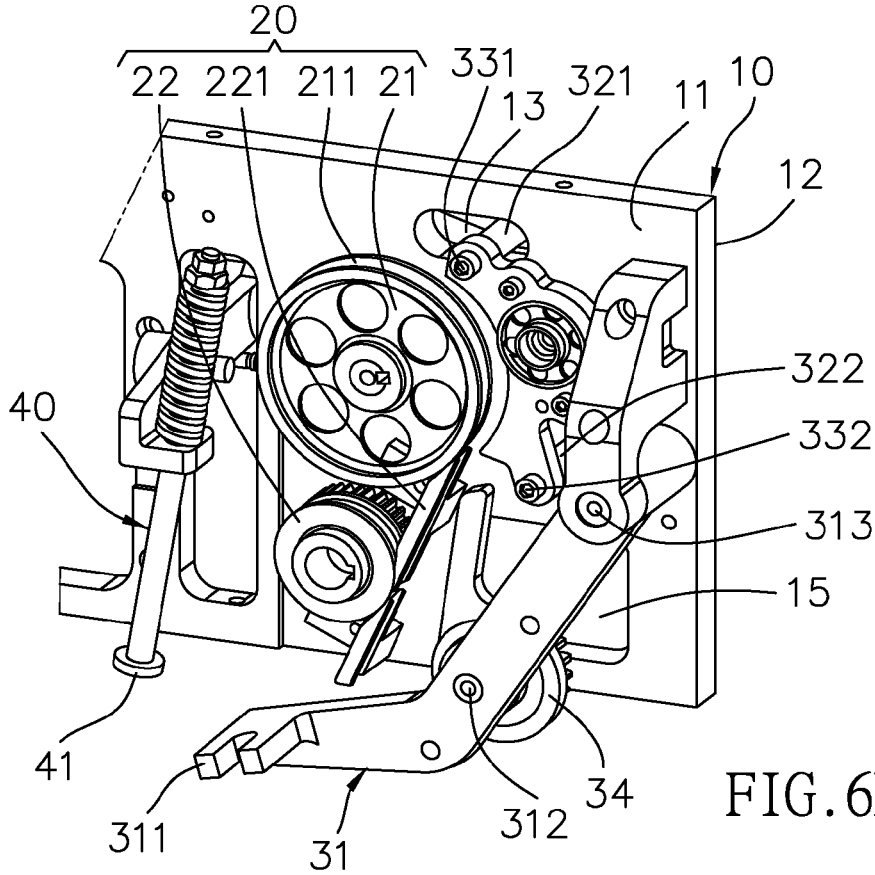
FIG. 6B is a perspective view showing another operating condition.
Figure 7:
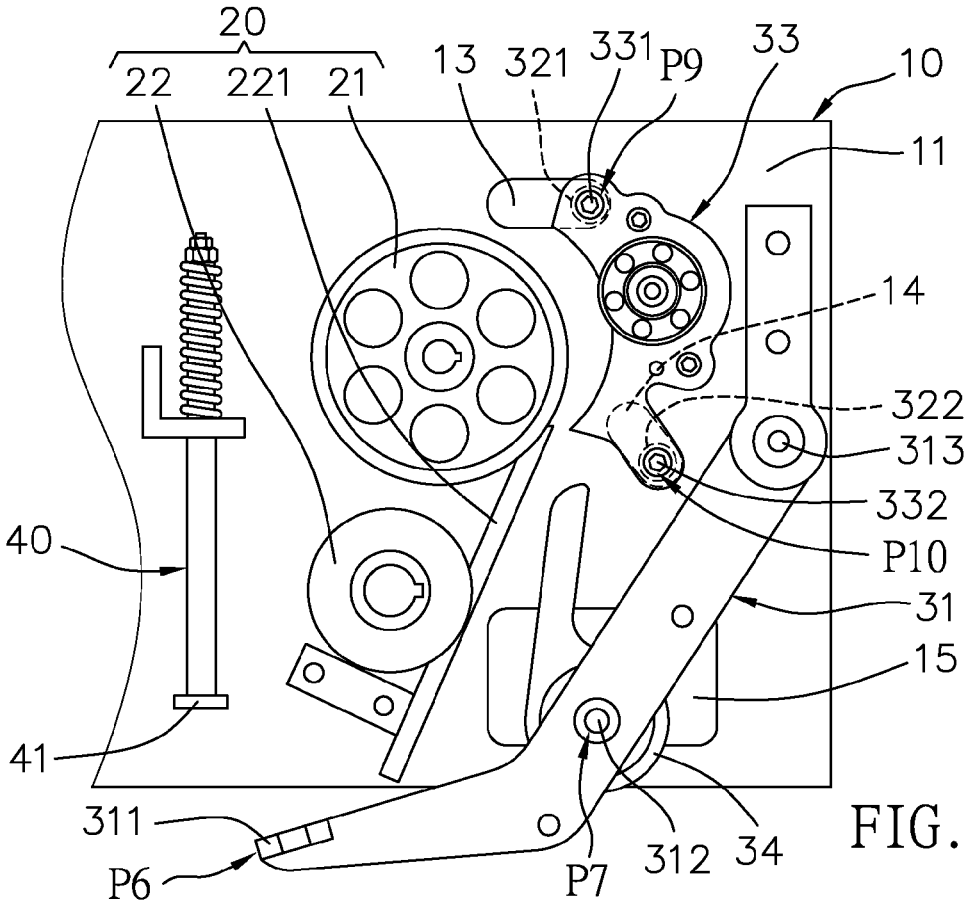
FIG. 7 is a perspective view illustrating the first surface of this invention when the first rod is released.
Figure 8:
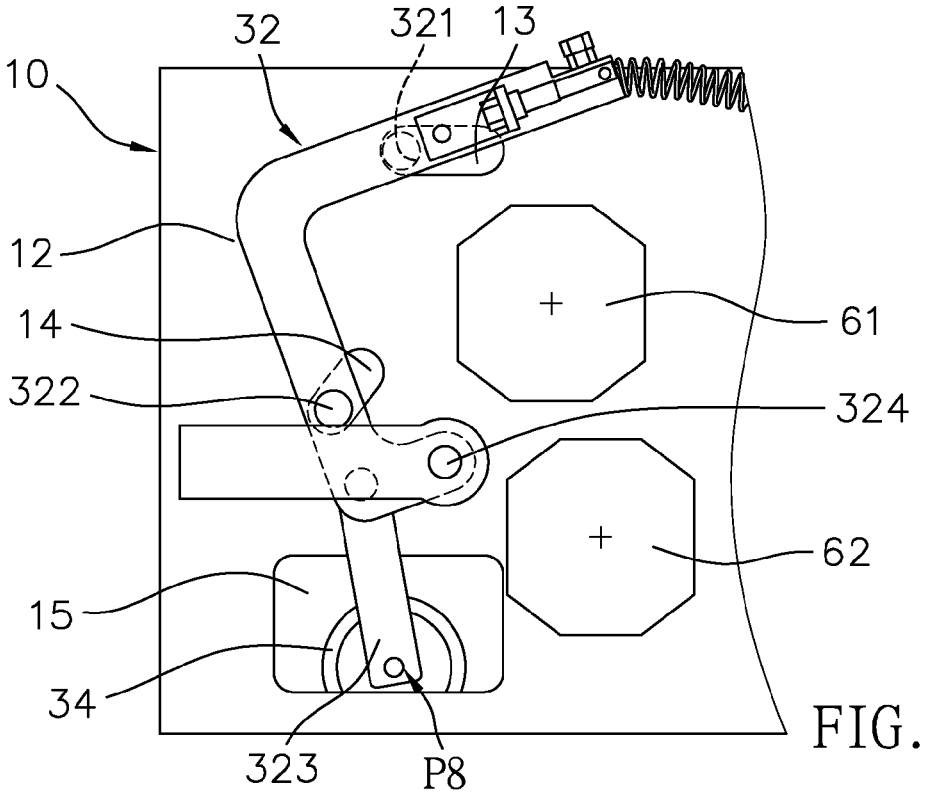
FIG. 8 is a perspective view illustrating the second surface of this invention when the first rod is released.

As illustrated in FIGS. 6A and 6B, when the locking portion 41 disengages with the fixing portion 311 of the first rod 31, the first rod 31 separates from the locking portion 42. Meanwhile, the first rod 31 rotates about the first pivoting portion 313 within a preset range. Referring to FIGS. 7 and 8, the fixing portion 311 moves from the first position P1 to a sixth position P6. The first pivoting portion 312 moves from the second position P2 to a seventh position P7. At the same moment, it causes the second matching portion 34 moves. Accordingly, the second matching portion 34 separates from both the first matching portion 33 and the second guide slot 221. Due to the movement of the second matching portion 34, the linking arm 323 moves from the fifth position P5 to an eighth position P8. Hence, such movement forces both the first sliding portion 321 and second sliding portion 322 of the second rod 32 moving to a ninth position P9 and a tenth position P10 respectively. Thus, the first matching 33 separates from the advance roller portion 21.

Based on the above description, the locking portion 41 can control the engaging condition (to engage or disengage) between the first matching portion 33 and second matching portion 34. If the strap 70 is jammed or stuck during the strap advancing or retreating process, the user only needs to make the locking portion 41 disengaging with the fixing portion 311 of the first rod 31 (such as pulling out). So, it can release the first and second matching portions 33, 34 easily. Hence, a maintenance space occurs immediately without using any tools. It is extremely easy to conduct the maintenance works.

Figure 9A:
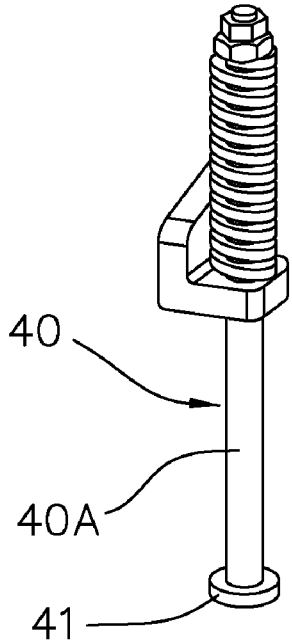
FIG. 9A is a perspective view of the engaging member of this invention.

Furthermore, it is optional that the engaging element 40 further includes a resilient member or mechanism (for example, the spring around the engaging element 40 shown in FIG. 2 or FIG. 9A) for making the locking portion 41 staying in a predetermined position.

Figure 9B:
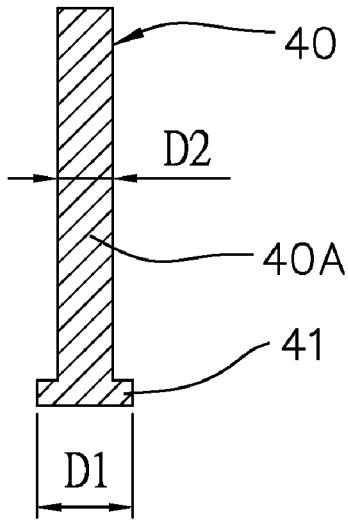
FIG. 9B is a cross-sectional view of the engaging member of this invention.

As shown in FIGS. 9A and 9B, the engaging element 40 is a rod consisted by a rod body 40A and the locking portion 41. The diameter (defined as D1) of the locking portion 41 is larger than the diameter (defined as D2) of the rod body 40A.

Therefore, the advantages and functions of this invention can be summarized as follows.

[1] The maintenance work can be done quickly without the use of tools. In the past, if the user wants to check or repair a malfunctioned traditional strapping machine 90, the user has to detach approximately four to six fixing elements 911. Then, the user can detach the parts secured with the guide slot 92. Therefore, it is very inconvenient to conduct the maintenance work. However, in the invention, the user only needs to make the locking portion 41 separating from the fixing portion 311 of the first rod 31. Then, the other related parts will be separated accordingly and then form a maintenance space. So, the maintenance work can be done quickly.

[2] It saves the detaching and assembling time. About the traditional one, the user needs to spend time to detach four to six fixing elements 911 secured thereon. After the maintenance is done, they need to be installed again. It really wastes a lot of time. However, due to the unique linking design in this invention, the related parts can be released quickly so as to form a maintenance space. Thus, it saves the detaching and assembling time.

[3] It can release automatically due to the gravity. Once the locking portion 41 separates from the fixing portion 311 of the first rod 31, the first rod 31 moves down because of its own weight (due to gravity). Then, the first rod 31 will rotate about the first rotating portion 313 for a preset range. Thus, it is advantageous that it can release automatically due to the gravity.

While this invention has been particularly shown and described with references to the preferred embodiments thereof, it will be understood by those skilled in the art that various changes or modifications can be made therein without departing from the scope of the invention by the appended claims.

What is claimed is:

1. An easy-maintenance strap guide system of a strapping machine comprising:

a board having a first surface, a second surface, a first guiding hole, a second guiding hole and an opening, said first guiding hole, said second guiding hole and said opening penetrating from said first surface to said second surface;

a driving set disposed on said first surface of said board, said driving set including an advance roller portion and a retreat roller portion, said advance roller portion having a first guide slot, said retreat roller portion having a second guide slot;

said advance roller portion and said retreat roller portion being driven by a first driving device and a second driving device respectively; said first guide slot and said second guide slot being provided for allowing a strap conveying therein;

a first rod disposed on said first surface, said first rod having a fixing portion, a first pivoting portion and a first rotating portion; said first rotating portion being disposed on said first surface so as to allow said first rod rotating within a predetermined range;

a second rod disposed on said second surface, said second rod having a first sliding portion, a second sliding portion, a linking arm and a second rotating portion; said first sliding portion and said second sliding portion being able to move inside said first guide slot and said second guide slot respectively; said second rotating portion being disposed on said second surface so as to allow said second rod rotating within another predetermined range;

a first matching portion disposed on said first surface, said first matching portion having a second pivoting portion and a third portion; said first sliding portion and said second sliding portion being through said first guide slot and said second sliding slot respectively as well as being pivoted with said second pivoting portion and said third pivoting portion respectively;

a second matching portion disposed on said first surface, said second matching portion having a fourth pivoting portion, said fourth pivoting portion being through said opening, said fourth pivoting portion having two ends, one end of said fourth pivoting portion being pivoted with said first pivoting portion of said first pivoting portion, the other end of said fourth pivoting portion being pivoted with said linking arm of said second rod; and an engaging element having a locking portion so as to engage or disengage with said first rod;

wherein when said locking porting engages with said fixing portion of said first rod, both said first matching portion and said second matching portion contact with said first and second guide slots so as to limit said strap that is movable in said first and second guide slots and to cause said second matching portion presses on said first matching portion; when said locking portion disengages with said fixing portion of said first rod, said first rod rotates and makes said second rod, said first matching and said second matching portion moving so that said second matching portion separates from said first matching portion and said second guide slot, and said first matching portion separates from said first guide slot.

2. The easy-maintenance strap guide system of a strapping machine as defined in claim 1, wherein said engaging element further includes a resilient member for making the locking portion staying in a predetermined position.

3. The easy-maintenance strap guide system of a strapping machine as defined in claim 1, wherein said engaging element is a rod consisted by a rod body and said locking portion, and a diameter of said locking portion is larger than another diameter of said rod body.

* * * * *